US007264141B2

(12) United States Patent
Patel et al.

(10) Patent No.: US 7,264,141 B2
(45) Date of Patent: Sep. 4, 2007

(54) FLUID DISPENSER WITH PASSIVE PRESSURIZATION

(75) Inventors: Amar Patel, Arlington Heights, IL (US); John Thompson, Medfield, MA (US)

(73) Assignee: Sanford, L.P., Oak Brook, IL (US)

( * ) Notice: Subject to any disclaimer, the term of this patent is extended or adjusted under 35 U.S.C. 154(b) by 504 days.

(21) Appl. No.: 10/781,963

(22) Filed: Feb. 19, 2004

(65) Prior Publication Data

US 2005/0184102 A1 Aug. 25, 2005

(51) Int. Cl.
*B65D 37/00* (2006.01)

(52) U.S. Cl. ..... 222/214; 222/182; 222/556

(58) Field of Classification Search ..... 222/214, 222/556, 182; 401/159
See application file for complete search history.

(56) References Cited

U.S. PATENT DOCUMENTS

| | | | | |
|---|---|---|---|---|
| 1,788,212 | A * | 1/1931 | Summer | 401/159 |
| 2,444,004 | A | 6/1948 | Chesler | 120/42.4 |
| 4,020,978 | A | 5/1977 | Szczepanski | |
| 4,511,273 | A | 4/1985 | Trotta | 401/260 |
| 4,572,691 | A | 2/1986 | Kirchhoff et al. | 401/214 |
| 4,812,071 | A | 3/1989 | Batra et al. | 401/264 |
| 4,813,463 | A | 3/1989 | Lin | 141/351 |
| 4,872,774 | A | 10/1989 | Rosso | 401/29 |
| 4,917,520 | A | 4/1990 | Reid | 401/127 |
| 4,917,521 | A | 4/1990 | Lai | 401/260 |
| 4,923,317 | A | 5/1990 | Bishop et al. | 401/205 |
| D309,913 | S | 8/1990 | Shintani | D19/43 |
| D310,449 | S | 9/1990 | Agrippino | D3/62 |
| D319,469 | S | 8/1991 | Rutter | D19/53 |
| 5,056,949 | A | 10/1991 | Petrillo | 401/214 |
| 5,061,104 | A | 10/1991 | Florjancic | 401/195 |
| D322,283 | S | 12/1991 | Perez et al. | D19/66 |
| D322,516 | S | 12/1991 | Korper | D4/121 |
| D324,879 | S | 3/1992 | Morgan | D19/36 |
| D325,931 | S | 5/1992 | Sekiguchi | D19/43 |
| D326,682 | S | 6/1992 | Kimura | D19/42 |
| 5,123,766 | A | 6/1992 | Babiak | 401/180 |
| D329,253 | S | 9/1992 | Sekiguchi | D19/43 |

(Continued)

FOREIGN PATENT DOCUMENTS

| | | |
|---|---|---|
| EP | 0 257 931 | 3/1988 |

(Continued)

OTHER PUBLICATIONS

International Search Report for PCT/US2004/037004.
Written Opinion of the ISA for PCT/US2004/037004.

*Primary Examiner*—Philippe Derakshani
(74) *Attorney, Agent, or Firm*—Marshall, Gerstein & Borun LLP

(57) ABSTRACT

A fluid dispenser from which fluid may be dispensed upon passive pressurization of a fluid reservoir therein. Upon exposing a nib of the fluid dispenser to the surroundings, either by disengagement of a cap or extension or contraction of the fluid dispenser, the fluid reservoir is pressurized without requiring the operator to exert manual force on the walls of the fluid dispenser. In certain embodiments, the rate of flow initiated passively may be increased by the operator actively engaging an interface, which increases the pressure within the fluid reservoir.

21 Claims, 4 Drawing Sheets

U.S. PATENT DOCUMENTS

| | | | | |
|---|---|---|---|---|
| D331,070 | S | 11/1992 | Hu Huang | D19/43 |
| 5,172,996 | A | 12/1992 | Tamiya et al. | 401/273 |
| 5,261,755 | A | 11/1993 | Draper et al. | 401/264 |
| D345,759 | S | 4/1994 | Poisson | D19/57 |
| D372,671 | S | 8/1996 | Bossert et al. | D9/347 |
| 5,632,906 | A | 5/1997 | Ishida et al. | 210/787 |
| 5,644,297 | A | 7/1997 | Masi et al. | 340/573 |
| 5,673,822 | A | 10/1997 | Chalmin et al. | |
| D388,119 | S | 12/1997 | Kuramoto | D19/51 |
| D399,256 | S | 10/1998 | Kelders | D19/53 |
| 5,915,872 | A | 6/1999 | Machida et al. | 401/251 |
| 5,971,648 | A | 10/1999 | Koreska | 401/260 |
| D420,387 | S | 2/2000 | Ku | D19/57 |
| 6,027,272 | A | 2/2000 | Spencer et al. | 401/158 |
| D428,441 | S | 7/2000 | Isobe et al. | D19/53 |
| D433,449 | S | 11/2000 | Fujiwara | D19/53 |
| D435,595 | S | 12/2000 | Kimura | D19/69 |
| D436,129 | S | 1/2001 | Fujihara | D19/53 |
| D442,992 | S | 5/2001 | Chevalier | D19/48 |
| D444,175 | S | 6/2001 | Omura | D19/49 |
| D447,175 | S | 8/2001 | Blom et al. | D19/46 |
| 6,269,982 | B1 | 8/2001 | Kreiseder et al. | 222/390 |
| 6,318,921 | B1 | 11/2001 | Craine | 401/131 |
| D451,960 | S | 12/2001 | Shimizu | D19/69 |
| D452,273 | S | 12/2001 | Blom et al. | D19/46 |
| D456,450 | S | 4/2002 | Kimura | D19/69 |
| D456,844 | S | 5/2002 | Oka | D19/49 |
| D457,564 | S | 5/2002 | Kimura | D19/53 |
| 6,402,411 | B2 | 6/2002 | Spencer et al. | 401/158 |
| 6,409,406 | B1 | 6/2002 | Schwartzman | 401/186 |
| 6,464,419 | B1 | 10/2002 | Chan | 401/131 |
| D466,938 | S | 12/2002 | Lee | D19/69 |
| D466,939 | S | 12/2002 | Lee | D19/69 |
| D467,617 | S | 12/2002 | Soetewey | D19/69 |
| 6,488,183 | B1 | 12/2002 | Braeuninger-Weimer et al. | 222/326 |
| D469,124 | S | 1/2003 | Koreska | D19/53 |
| D469,806 | S | 2/2003 | Chan | D19/46 |
| 6,572,297 | B2 | 6/2003 | Korper | 401/186 |
| 6,672,487 | B1 | 1/2004 | Lohrman | 222/213 |

FOREIGN PATENT DOCUMENTS

| | | |
|---|---|---|
| FR | 2 649 074 | 1/1991 |
| JP | 7195896 | 8/1995 |
| JP | 8052984 | 2/1996 |
| JP | 8282187 | 10/1996 |
| WO | WO83/01600 | 5/1983 |
| WO | WO87/01338 | 3/1987 |
| WO | WO92/05966 | 4/1992 |
| WO | WO93/23485 | 11/1993 |
| WO | WO 2004/013009 | 2/2004 |

* cited by examiner

FIG. 2
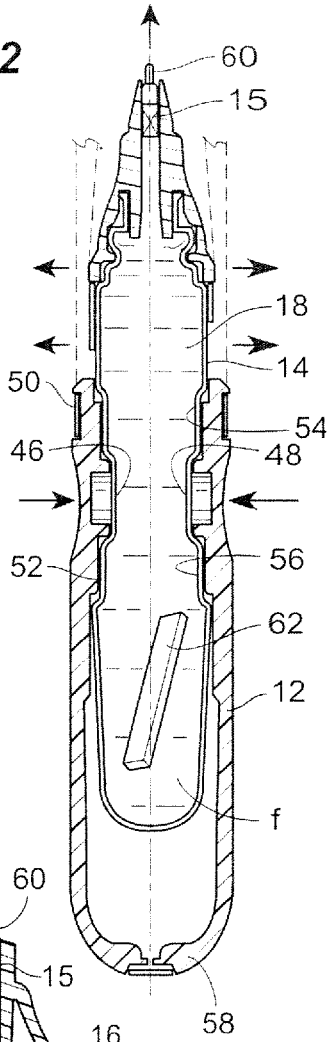
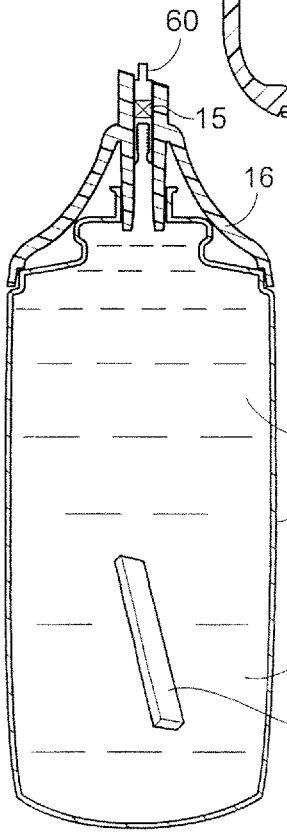
FIG. 3
FIG. 4
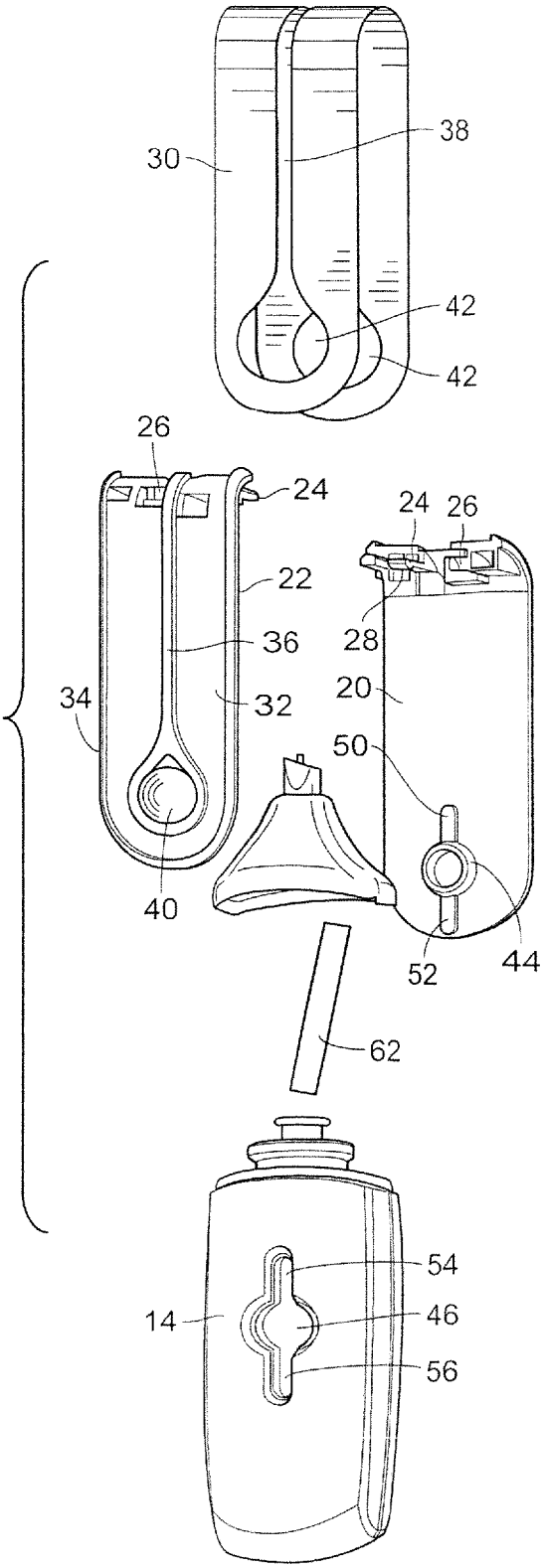

FLUID DISPENSER WITH PASSIVE PRESSURIZATION

FIELD OF THE DISCLOSURE

This disclosure relates to the field of fluid dispensers generally and, more specifically, to dispensers of correction fluid, ink, paint, and the like which utilize pressurized reservoirs to discharge fluid from the dispenser.

DESCRIPTION OF THE SEVERAL VIEWS OF THE DRAWING

FIG. 2 is a cross-sectional view taken along lines 2-2 of FIG. 1, but showing in solid lines the rotated position of the cap for the fluid dispenser with the tip in an exposed condition and the fluid dispenser pressurized, and showing in broken lines, broken away, the position of the cap for the fluid dispenser with the tip in a concealed condition;

FIG. 3 is a cross-sectional view taken along lines 3-3 of FIG. 1;

FIG. 4 is an exploded view of the fluid dispenser shown in FIG. 1;

DETAILED DESCRIPTION OF THE PREFERRED EMBODIMENTS

Figure 1:
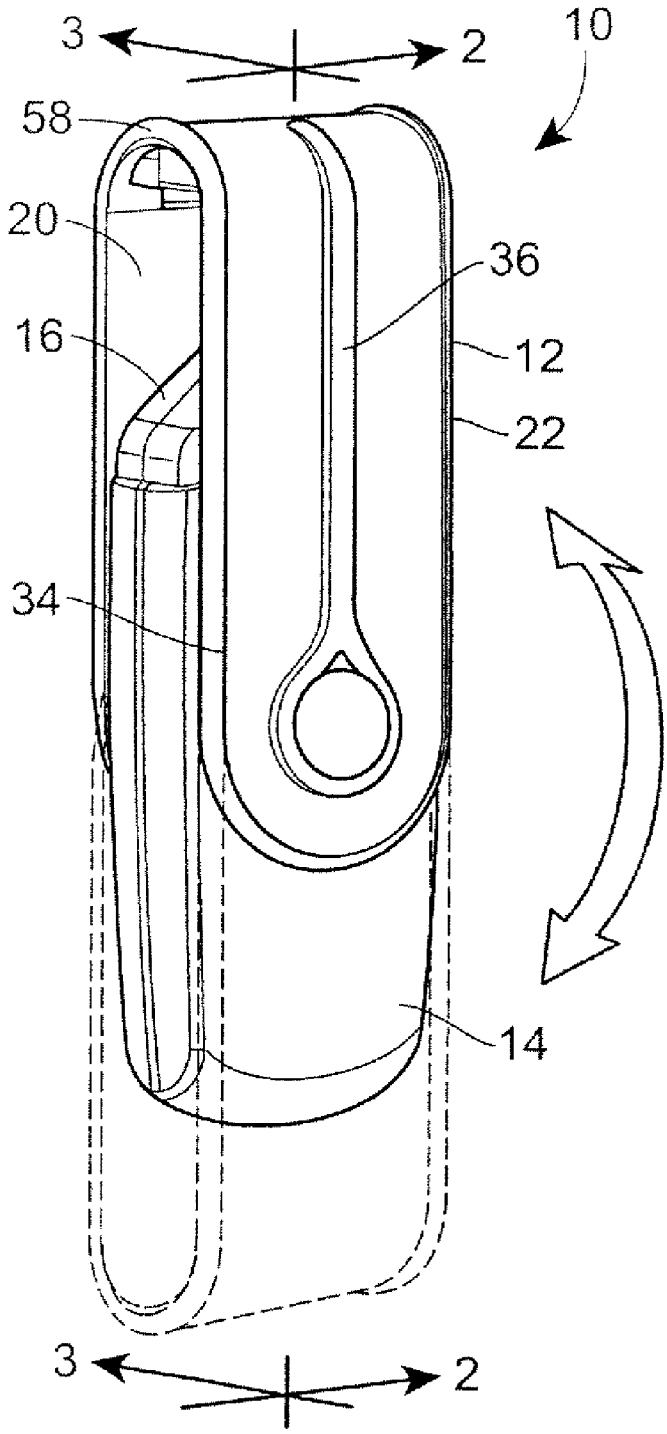
FIG. 1 is a perspective view of a first embodiment of a fluid dispenser made in accordance with the present disclosure, showing in solid lines the position of the cap for the fluid dispenser with the tip in a concealed condition, and showing in broken lines the rotated position of the cap for the fluid dispenser with the tip in an exposed condition and the fluid dispenser pressurized.

With reference to the drawing figures, various preferred embodiments of a fluid dispenser are herein described. While one particularly advantageous use of the fluid dispensers of the present disclosure is a dispenser for correction fluid, it is appreciated by those ordinarily skilled in the art that the particular fluid to be dispensed may be of many forms. It is desirable, however, that the fluid to be dispensed has a sufficiently high viscosity to facilitate gradual dispensing from the fluid dispenser, i.e. to resist unintentional spillage of fluid, or that a control member, such as a valve, be provided to control lower viscosity fluids.

FIGS. 1-4 depict a first embodiment of a fluid dispenser 10. The fluid dispenser 10 includes a cap 12, a main dispenser body 14, and a substantially rigid tip portion 16. The main dispenser body 14 defines a fluid reservoir 18, and is preferably made of a resilient, semi-rigid, deformable, shape-recoverable material, such as plastic. A suitable material for the main dispenser body 14 exhibiting these desirable characteristics is a blow moldable grade of unfilled nylon 6, for instance Novamid ST110BH available from Mitsubishi Engineering Plastics Corp.

Fluid from the reservoir 18 is dispensed from a tip 60. As shown schematically in FIGS. 2 and 3, a control member, such as a valve 15, may be provided between the reservoir 18 and the tip 60 to control flow of fluid to the tip 60. The valve 15, however, may be removed without departing from the scope of the present disclosure. For example, the fluid to be dispensed may be sufficiently viscous that it does not flow from the tip 60 during the time period between opening the cap 12 and placing the tip against the surface to be marked. Alternatively, a structure that does not include a valve member, such as a capillary structure, may be provided for less viscous fluids such that the fluid is delayed from reaching the tip 60 for a period of time sufficient to place the tip 60 against the surface.

The cap 12 rotates, or swings, between a non-dispensing or closed position, as shown in solid lines in FIG. 1, and a dispensing or open position, as shown in broken lines in FIG. 1. The phrase "dispensing position" as used herein does not necessarily mean that fluid is automatically dispensed when the cap is in that position. Instead, when the cap 12 is in the dispensing position, the dispenser 10 may merely be capable of dispensing fluid, and fluid flow may not begin until a control member such as the valve 15, if provided, is actuated to an open position. In dispensers having a control member, the cap need only protect the tip 60 in the closed position to prevent inadvertent contact with a surface. For dispensers that do not include a control member, the cap may also completely cover and/or seal the tip 60 to prevent discharge of fluid. The cap 12 is preferably formed of a generally U-shaped profile, with opposing legs 20, 22. As shown in FIG. 4, the opposing legs 20, 22 may be formed separately, and fastened together via tongue projections 24 provided at the top of at least one of the legs 20, 22, and complementary grooves 26 at the top of the other of the legs 20, 22. Each of the tongue projections 24 may be provided with a hook-like end 28, to facilitate locking the opposing legs 20, 22 of the cap 12 together. The opposing legs 20, 22 may be manufactured as identical parts, so as to reduce complexity in manufacturing. For instance, the legs 20, 22 may be provided with hermaphroditic tongue 24 and groove 26 connectors, such that the legs 20, 22 are interchangeable.

A force member in the form of a resilient spring clip 30 is provided over the legs 20, 22 of the cap 12. In the embodiment shown in FIGS. 1-4, the legs 20, 22 are provided with a recessed region 32 extending over a substantial portion of the exterior of each of the legs 20, 22, bounded by a retaining wall 34. The legs 20, 22 are preferably additionally provided with an elongated central ridge 36. The resilient clip 30 is provided with a centrally-located, complementary, ridge-receiving slit or opening 38. Once the opposing legs 20, 22 are interconnected, the resilient spring clip 30 is placed over the opposing legs 20, 22, and received in the recessed region 32 of the opposing legs 20, 22, with the central ridge 36 projecting through the ridge-receiving slit 38 in the resilient spring clip 30.

Each of the opposing legs 20, 22 is also preferably provided with an interface, such as a recessed button 40 at the bottom of the central ridge 36. The recessed button 40 is preferably of a shape to facilitate placement of an operator's fingertip or thumbtip therein. The resilient spring clip 30 is further provided with interface access openings 42 at either end of the ridge-receiving slit 38, so that when the spring clip 30 is received in the recessed region 32, the recessed button 40 is accessible. Each of the opposing legs 20, 22 is further provided with an inwardly-directed ring 44 projecting from an interior surface thereof.

The main dispenser body 14 has opposing recesses 46, 48 therein. The opposing recesses 46, 48 are preferably round, and receive the inwardly-directed rings 44 projecting from the interior surface of the opposing legs 20, 22 of the cap 12. Once the inwardly-directed rings 44 are received in the opposing recesses 46, 48, the cap 12 is rotatable with respect to the main dispenser body 14. One or more locking tabs 50, 52 may be provided as extensions from the inwardly-directed rings 44, with complementary locking recesses 54, 56 extending from the opposing recesses 46, 48, to retain the cap 12 in either an open position or a closed position. For example, locking tabs 50, 52 are selectively received in the complementary recesses 54, 56 while the cap 12 is in the closed position, such that the substantially rigid tip portion 16 is not exposed, thereby locking the cap 12 in the closed position.

An application of a suitable amount of force to the curved end 58 of the cap 12 to overcome the resistance caused by the presence of the locking tabs 50, 52 in the locking recesses 54, 56, commensurate with the force necessary to remove of a cap of a conventional writing utensil, causes the locking tabs 50, 52 to move out of the complementary locking recesses 54, 56, allowing the cap 12 to swivel or rotate to an open position. When the locking tabs 50, 52 again align with the complementary locking recesses 54, 56, the cap 12 is locked in the open position. To re-close the fluid dispenser 10, the operator need only again apply a suitable amount of force to the curved end 58 of the cap 12 to overcome the resistance, again causing the locking tabs 50, 52 to move out of the complementary locking recesses 54, 56, and allowing the cap 12 to swing back to the closed position. The ability of the cap 12 to rotate between open and closed positions is indicated by the double-headed arrow in FIG. 1. It is recognized that the cap 12 may have a 180° range of motion, or preferably, a 360° range of motion, such that the cap could be rotated in either direction to change from an open to a closed position and vice-versa.

The resilient spring clip 30 biases the opposing legs 20, 22 toward one another. While the cap 12 is in the closed position, the opposing legs 20, 22 engage the substantially rigid tip portion 16, forcing the opposing legs 20, 22 outwardly, to a substantially parallel orientation, thereby causing the opposing legs 20, 22 to resist the biasing force of the resilient spring clip 30. As used herein, it is to be understood that "substantially rigid" describes a tip portion that has sufficient rigidity to overcome the biasing force of a spring member, even after repeated openings and closings of the fluid dispenser. For example, in this embodiment, the substantially rigid tip portion 16 has sufficient rigidity to overcome the biasing force of the resilient spring clip 30, so as to ensure the opposing legs 20, 22 of the cap are pushed apart from one another, into the substantially parallel orientation, when positioned over the substantially rigid tip portion 16. The tip portion 16 may therefore be somewhat flexible and/or compressible, but still be considered substantially rigid. When the cap 12 is swiveled or rotated toward the open position, the opposing legs 20, 22 disengage from the substantially rigid tip portion 16. Due to the restoring force of the resilient spring clip 30, the opposing legs 20, 22 bend toward one another, thereby compressing the main dispenser body 14. By compressing the main dispenser body 14, the fluid reservoir 18 defined by the main dispenser body 14 is likewise compressed, causing fluid f retained in the fluid reservoir 18 to exit the fluid reservoir 18 through a nib 60 provided in the substantially rigid tip portion 16, so that the fluid f may be applied to a surface, such as a piece of paper.

Fluid may be passively pressurized within the reservoir 18 upon swiveling the cap 12 to an open position. The valve 15 may then be actuated to an open position to dispense fluid from the tip 60. Alternatively, if no valve 15 is provided, the fluid may be dispensed immediately or after a delay period upon placing the cap 12 in the open position. Depending on the viscosity of the fluid f, it may be the case that the operator desires the fluid f to be dispensed faster than the rate at which the fluid is passively dispensed due to the compression of the main dispenser body 14 by the cap 12. The operator may advantageously apply pressure to the recessed buttons 40, or other similar interface, provided along the opposing legs 20, 22. The interface may alternatively be provided on the main dispenser body 14 itself, rather than on the cap 12. The recessed buttons 40 are preferably located substantially opposite the inwardly-directed rings 44, such that pressure applied to the raised buttons 40 while the cap 12 of the fluid dispenser 10 is in an open position increases the compression of the fluid reservoir 18, causing the fluid f to be dispensed at a faster rate. Because some fluids tend to congeal or separate over time, a mixing slug 62 may also be provided in the reservoir 18. While the fluid dispenser 10 is shown to have a generally rectangular shape, it is recognized that the fluid dispenser 10 may have other shapes, such as generally cylindrical.

Various types of known writing tips and valves may be used in the fluid dispenser 10. For example, the tip 60 may be a ball point having one or more ball members which also provide the control member. Alternatively, the tip 60 may be a conduit formed of metal or plastic. To control fluid flow through the conduit, the valve 15 may be a pin valve that actuates in response to writing pressure, a paint-marker valve that requires a pushing force to open, or other known type of valve, or a combination of any such valves. Alternatively, a non-valved system, such as a capillary structure, may be provided to control or delay flow of fluid to the tip 60.

Figure 5:
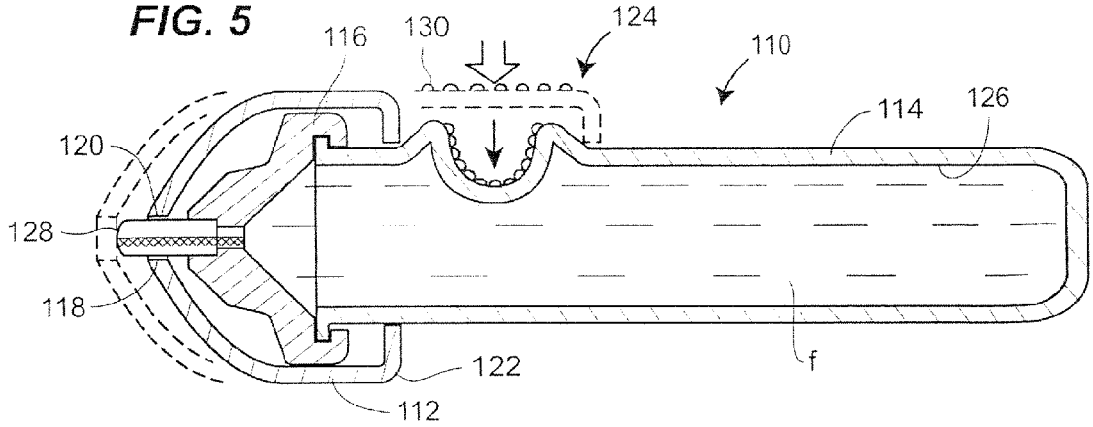
FIG. 5 is a cross-sectional view of a second embodiment of a fluid dispenser made in accordance with the present disclosure, showing in solid lines the position of the cap for the fluid dispenser with the tip in an exposed condition and the fluid dispenser pressurized, and showing in broken lines the extended position of the cap of the fluid dispenser with the tip in a concealed condition.

Turning to FIG. 5, a second embodiment of the fluid dispenser is shown in cross-section. The fluid dispenser 110 of the second embodiment includes a cap 112, a main dispenser body 114, and a substantially rigid tip portion 116. The cap 112 includes a nib-receiving aperture 118 at a distal end 120 thereof. While the cap 112 is in a retracted position, as indicated in solid lines in FIG. 5, a proximal end 122 of the cap 112 engages an interface in the form of an outwardly-projecting button member 124 provided along the main dispenser body 114. As in the first embodiment, the main dispenser body 114 defines a fluid reservoir 126. At least in an area of the button member 124, the main dispenser body 114 is preferably made of a semi-rigid, deform able, shape-recoverable material, such as plastic. A nib 128 extends from the substantially rigid tip portion 116. While the cap 112 is in the retracted position, the nib 128 is exposed.

The button member 124 is situated and adapted such that upon engagement with the proximal end 122 of the cap 112, the button member 124 causes the main dispenser body 114 to compress, thereby pressurizing the fluid f in the fluid reservoir 126. The cap 112 in conjunction with the button member 124 thereby act together as a force member. Pressurization of the fluid f in the fluid reservoir 126 generates a pressure force sufficient to dispense the fluid f from the fluid dispenser 110 through the nib 128. Fluid f is thereby passively pressurized by the fluid dispenser 110 upon movement of the cap 112 to the retracted position.

In order to dispense the fluid f faster than the rate at which the fluid f is dispensed due to the compression of the main dispenser body 114 by the cap 112, an operator may advantageously apply pressure to the button member 124 in the direction of the arrow indicated in the drawing. Pressure applied to the button member 124 while the cap 112 of the fluid dispenser 110 is in a retracted position increases the compression of the fluid reservoir 126, causing the fluid f to be dispensed at a faster rate. The button member 124 is preferably provided with tactilely satisfactory topography, such as a plurality of ridges 130. It will be appreciated by those in the art that the displacement of the button member 124 is exaggerated to some extent in FIG. 5, and represents, albeit in a somewhat exaggerated manner, displacement of the button member 124 not only due to engagement with the proximal end 122 of the cap 112, but also further displacement due to manual application of force by an operator to increase the rate of flow of fluid f. It will be further appreciated that displacement of the button member 124 solely due to engagement with the proximal end 122 of the cap 112 would generally be less pronounced than the displacement of the button member 124 when coupled with the manual application of force by an operator on the button member 124.

The cap 112 of the fluid dispenser 110 is preferably movable to an extended position, as shown in broken lines in FIG. 5. In the extended position, the proximate end 122 of the cap 112 disengages from the button member 124, and the nib 128 is concealed by the distal end 120 of the cap 112. Upon disengagement of the proximate end 122 of the cap 112, the button member 124, as well as any additional compressed portion of the main dispenser body 114, recovers its pre-compressed shape, thereby reducing the pressure on the fluid f.

The cap 112 is preferably permanently retained on fluid dispenser 10. For example, the proximate end 122 of the cap 112 may be bounded between the button member 124 and the substantially rigid tip portion 116. A slide or twist mechanism (not shown), or some combination thereof, may be used to actuate the cap 112 between an extended position and a retracted position.

Figure 6:
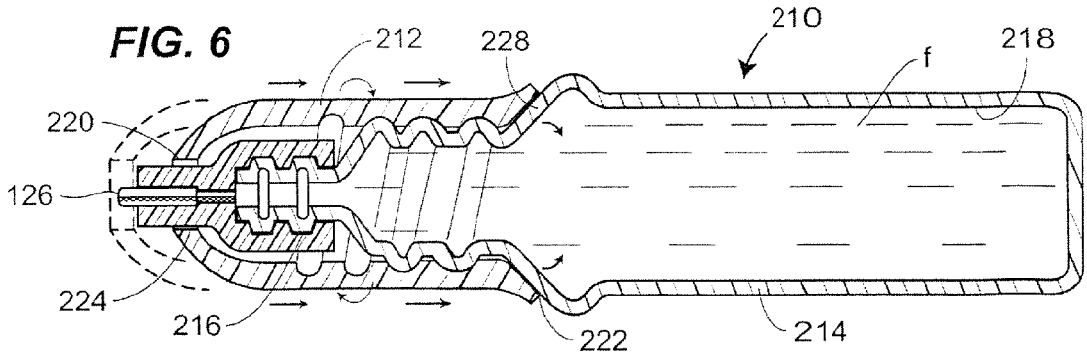
FIG. 6 is a cross-sectional view of a third embodiment of a fluid dispenser made in accordance with the present disclosure, showing in solid lines the position of the cap for the fluid dispenser with the tip in an exposed condition and the fluid dispenser pressurized, and showing in broken lines the extended position of the cap of the fluid dispenser with the tip in a concealed condition.

In a third embodiment, as shown in FIG. 6, the fluid dispenser 210 has a cap 212 threadedly engaged with a main dispenser body 214. As in the second embodiment, the cap 212 is movable between a retracted position, shown in solid lines in the drawing, and an extended position, represented in broken lines. The fluid dispenser 210 further includes a substantially rigid tip portion 216 in combination with the main dispenser body 214. The main dispenser body 214 defines a fluid reservoir 218.

The cap 212 has a distal end 220 and a proximate end 222. The distal end 220 has a nib-receiving aperture 224. The nib-receiving aperture 224 may be of sufficient size to receive the region of the tip portion 216 in which a nib 226 is secured, as shown in FIG. 6, or alternatively, may be sized to receive only the nib 226. When the cap 212 is twisted to its extended position, the nib 226 is concealed by the distal end 220 of the cap 212. This advantageously prevents residual fluid f on the distal end of the nib 226 from undesirably dripping onto a surface, such as a piece of paper. The dispenser 210 may also include a control member similar to the valve 15 of the first embodiment to further prevent inadvertent fluid flow from the nib 226. When the cap 212 is twisted to its retracted position, the nib 226 is exposed and the proximate end 222 engages a resilient collapsible portion 228 of the main dispenser body 214 which is preferably made of a semi-rigid, deformable, shape-recoverable material, such as plastic.

Upon such engagement, the resilient collapsible portion 228 of the main dispenser body 214 is compressed, reducing the volume of the fluid reservoir 218, thereby pressurizing fluid f contained in the fluid reservoir 218. If no control member is provided, pressurization of the fluid results in the fluid f being passively dispensed through the nib 226. Alternatively, if a control member is provided between the reservoir 218 and the nib 226, an additional step to actuate the control member to the open position may be necessary before fluid will flow to the nib 226. In either instance, fluid f is passively pressurized in the fluid reservoir 218 upon rotational movement of the cap 212 to the retracted position. When the cap 212 is twisted back to its extended position the resilient collapsible portion 228 returns to its uncompressed shape, thereby equalizing the pressure within the fluid reservoir 218. While not shown in FIG. 6, the fluid dispenser 210 of the third embodiment may be provided with an interface along the main dispenser body 214 in order to allow the operator to selectively increase the rate of flow of the fluid f from the fluid dispenser 210.

Figure 7:
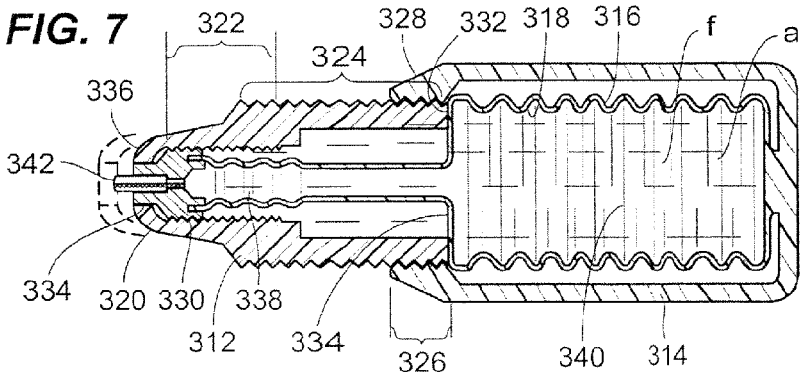
FIG. 7 is a cross-sectional view of a fourth embodiment of a fluid dispenser made in accordance with the present disclosure, showing in solid lines a shroud of the fluid dispenser in a retracted position, such that the nib of the fluid dispenser is exposed, and showing in broken lines the shroud in an extended position, wherein the nib is concealed.

A fourth embodiment is shown in cross-section in FIG. 7, in which a fluid dispenser 310 is provided having a shroud, which for purposes of this disclosure is also considered a cap 312, a main dispenser body 314, an internal collapsible bladder 316 defining a fluid reservoir 318, and a tip portion 320. The shroud or cap 312 preferably includes an internally threaded region 322 and an externally threaded region 324.

The externally threaded region 324 engages an internally threaded portion 326 provided at a first end 328 of the main dispenser body 314. The internally threaded region 322 engages external threads 330 provided on the tip 320. The external threads 330 are preferably oriented in the same direction, and with a complementary pitch, to the externally threaded region 324, such that rotation of the shroud or cap 312 results in movement of the cap 312 relative to both the main dispenser body 314 and the tip 320.

A proximate end 332 of the shroud or cap 312 abuts a surface 334 of the internal collapsible bladder 316 at least when the cap 312 is actuated toward its retracted position. Continued rotation of the cap 312 toward its retracted position causes the internal collapsible bladder 316 to compress, pressurizing fluid f within the fluid reservoir 318 defined by the internal collapsible bladder 316. At least the proximate end 332 of the cap 312 thereby acts as a force member. The cap 312 is provided with a nib-receiving opening 334 in a distal end 336 thereof, as in the second or third embodiments.

Upon rotating the cap 312 toward its extended position, the collapsible internal bladder 316 returns to substantially its pre-compressed shape, and the pressure within the fluid reservoir 318 equalizes. The internal collapsible bladder 316 preferably has two interconnected chambers, with one of the chambers being a relatively small bellows portion 338 and the other chamber being a relatively large bellows portion 340. At least some of the large bellows portion 338 is occupied by a gas a, such as air. The volume of the large bellows portion 340 may be significantly greater than the volume of the small bellows portion 338. Thus, as the shroud or cap 312 is twisted relative to the main dispenser body 314, fluid and gas occupying the relatively larger volume within the large bellows portion 340 is forced in the direction of the small bellows portion 338, thereby pressurizing the contents. Fluid f is thereby passively pressurized in the fluid reservoir 318 upon rotational movement of the cap 312 to the retracted position.

Figure 8:
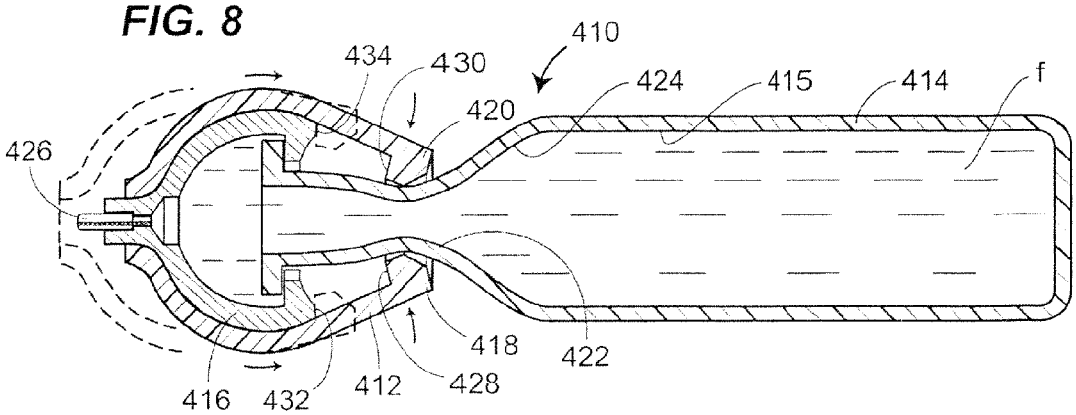
FIG. 8 is a cross-sectional view of a fifth embodiment of a fluid dispenser made in accordance with the present disclosure, showing in solid lines a shroud of the fluid dispenser in a retracted position, such that the nib of the fluid dispenser is exposed, and showing in broken lines the shroud in an extended position, wherein the nib is concealed.

Turning to FIG. 8, a fifth embodiment of a fluid dispenser 410 includes a cap 412, a main dispenser body 414, and a substantially rigid tip portion 416. The main dispenser body 414 defines a fluid reservoir 415. The cap 412 is preferably made primarily of a resilient material such as a spring, with legs 418, 420 that are biased toward one another, as represented by the generally upwardly directed and generally downwardly directed arrows in FIG. 8 in the immediate vicinity of the legs 418, 420. The cap 412 thereby acts as a force member. The walls 422, 424 of the main dispenser body 414 are compressible.

The cap 412 is moveable between an open position, as shown in solid lines in FIG. 8, and a closed position, as represented by broken lines in the drawing figure. As the cap 412 is moved to its open position, the legs 418, 420 of the cap 412 approach one another, thereby compressing the walls 422, 424 between the legs 418, 420 and pressurizing the fluid f inside the fluid reservoir 415. The pressurized fluid f may then be dispensed through a nib 426 provided in the substantially rigid tip portion 416 either directly or through a control member that has been actuated to an open position. Fluid f is thereby passively pressurized in the fluid reservoir 415 upon movement of the cap 412 to the open position. The operator may selectively increase the rate at which the fluid f is dispensed by manually applying pressure to the main dispenser body 414.

As the cap 412 is moved from the open position to the closed position, the substantially rigid tip portion 416 forces the legs 418, 420 apart, such that the legs 418, 420 ride along the outer walls of the substantially rigid tip portion 416 until inwardly-directed stop walls 428, 430 provided on the legs 418, 420 of the cap 412 abut complementary proximate ends 432, 434 of the substantially rigid tip portion 416. Once the legs 418, 420 of the cap 412 lose contact with the walls 422, 424 of the main dispenser body 414, the walls 422, 424 return to their uncompressed shape and the pressure in the fluid reservoir 418 is reduced. Favorably, the cap 412, when in the closed position, also conceals the nib 426 from view, as in certain of the embodiments described above.

Figure 9:
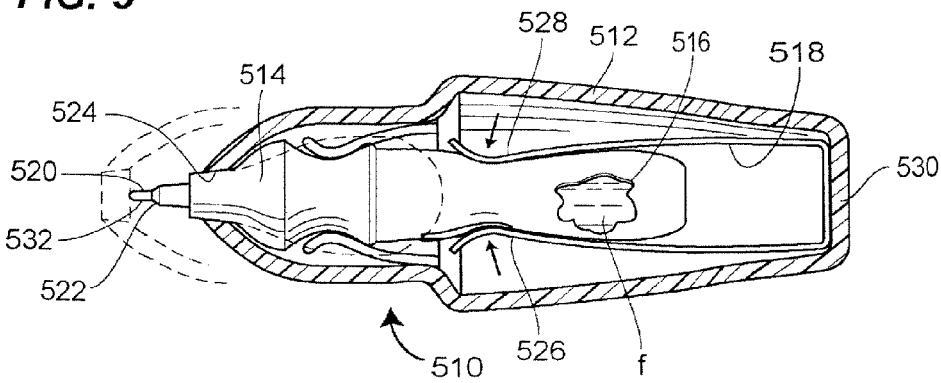
FIG. 9 is a cross-sectional view of a sixth embodiment of a fluid dispenser made in accordance with the present disclosure, showing in solid lines a substantially rigid tip portion in an extended position, such that the nib of the fluid dispenser is exposed, and showing in broken lines an outer casing of the fluid dispenser while the tip holder is in a retracted position, wherein the nib is concealed.

FIG. 9 shows a sixth embodiment of a fluid dispenser 510. The fluid dispenser 510 includes a main dispenser body 512, a substantially rigid tip portion 514, a compressible fluid-containing bladder 516, and a spring 518. A nib 520 extends from a distal end 522 of the substantially rigid tip portion 514. The substantially rigid tip portion 514, the nib 520, and the compressible bladder 516 move as substantially a single unit relative to the main dispenser body 512 and spring 518, which operate together as a second unit. In FIG. 9, the fluid dispenser 510 is shown with the substantially rigid tip portion 514, the nib 520, and the compressible bladder 516 in an extended position relative to the main dispenser body 512, such that the nib 520 extends outside of the main dispenser body 512 through a nib-receiving aperture 524 in a distal end of the main dispenser body 512.

In this extended position, the spring 518, which includes two legs 526 and 528 biased toward one another, compresses the bladder 516. The spring 518 thereby acts as a force member. By compressing the bladder 516, the pressure within the bladder 516 increases. The pressurized fluid f contained within the bladder 516 may then be dispensed from the fluid dispenser 510. Fluid f is thereby passively pressurized in the bladder 516 upon movement of the main dispenser body 512 to the retracted position.

The substantially rigid tip portion 514, the nib 520, and the bladder 516 are also movable to a retracted position, as represented by broken lines in FIG. 9, in which the nib 520 is withdrawn into the nib-receiving aperture 524. Inasmuch as the main dispenser body 512 serves as structure that conceals the nib 520 while the substantially rigid tip portion 514, the nib 520, and the bladder 516 are in the retracted position, in this embodiment the main dispenser body 512 is also the cap. As the substantially rigid tip portion 514 moves toward a proximate end 530 of the main dispenser body 512, the legs 526, 528 of the spring 518 are forced apart from one another by the substantially rigid tip portion 514, thereby removing compressive force from the bladder 516. The nib 520 is preferably provided with an air hole 532 through which the bladder 516 draws air upon removal of the compressive force therefrom. By drawing air into the bladder 516 through the air hole 532 in the nib 520, the pressure in the bladder 516 reduces, which may stop the flow of fluid f through the nib 520.

Figure 10:
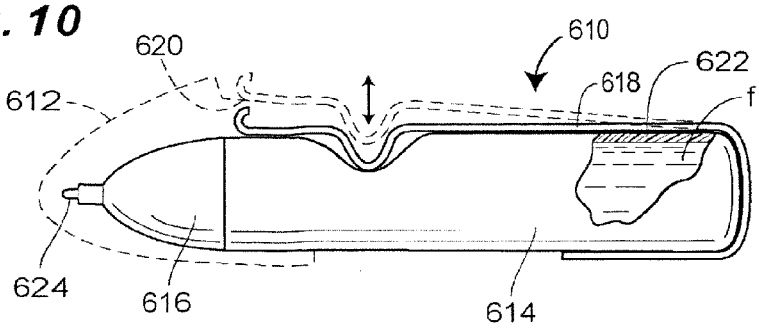
FIG. 10 is a perspective view of a seventh embodiment of a fluid dispenser made in accordance with the present disclosure, showing in solid lines a spring associated with the exterior of the fluid dispenser while the fluid dispenser is in an uncapped condition, and showing in broken lines the spring while the fluid dispenser is in a capped condition.

FIG. 10 shows a seventh embodiment of a fluid dispenser 610, including a removable cap 612 (shown in broken lines), a compressible main dispenser body 614, a substantially rigid tip portion 616, and a spring 618 associated with the main dispenser body 614, the spring 618 being on the exterior of the main dispenser body 614. As indicated in broken lines in FIG. 10, when the cap 612 is positioned over the substantially rigid tip portion 616, a spring-retaining tab 620 of the cap 612 prevents the spring 618 from compressing the compressible main dispenser body 614. When the cap 612 is removed, as shown in solid lines in the drawing figure, the spring 618 compresses the main dispenser body 614, thereby pressurizing a fluid retaining reservoir 622 defined by the main dispenser body 614. The fluid f contained in the reservoir 622 may then be dispensed through a nib 624. The spring 618 thereby acts as a force member, and the fluid f is passively pressurized in the reservoir 622 upon removal of the cap 612 from the main dispenser body 614. The operator may selectively increase the rate at which fluid is dispensed by manually applying pressure to the main dispenser body 614.

Figure 11:
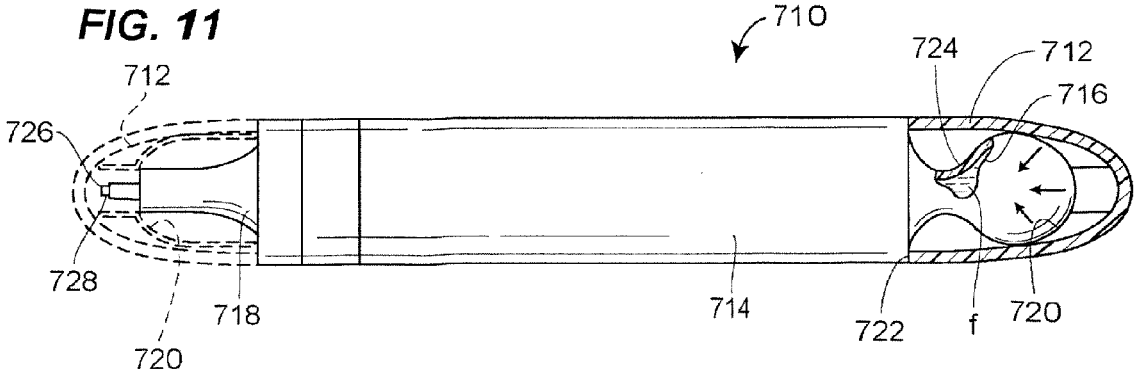
FIG. 11 is a perspective and partial cross-section view of an eighth embodiment of a fluid dispenser made in accordance with the present disclosure, showing in solid lines the nib of the fluid dispenser in an exposed condition, and showing in broken lines an outer casing of the fluid dispenser while the nib is in a concealed position.

Turning now to FIG. 11, an eighth embodiment of a fluid dispenser 710 is shown. The fluid dispenser 710 includes a removable cap 712, a main dispenser body 714, a compressible bladder 716, and a tip portion 718. The interior of the cap 712 is provided with one or more bladder compression surfaces 720, arranged such that when the cap 712 is placed on the proximate end 722 of the main dispenser body 714, the bladder compression surface or surfaces 720 compresses the compressible bladder 716. At least the portion of the cap 712 defined by the one or more bladder compression surfaces 720 thereby acts as a force member.

The compressible bladder 716 defines a portion of a fluid reservoir 724, which extends through the main dispenser body 714. As the bladder compression surface or surfaces 720 compresses the compressible bladder 716, the fluid reservoir 724 is pressurized. With the fluid reservoir 724 pressurized, fluid f contained therein may then be dispensed through a nib 726 extending from the tip 718. The fluid f is thereby passively pressurized in the fluid reservoir 724 upon placement of the cap 712 on the proximate end 722 of the main dispenser body 714. The nib 726 is preferably provided with an air inlet hole 728, so that when the cap 712 is removed from the proximate end 722 of the main dispenser body 714, ambient air is drawn into the compressible bladder 716, thereby lowering the pressure back to equilibrium and causing the compressible bladder 716 to recover its uncompressed shape. With the pressure in the bladder 716 equalized, fluid flow through the nib 716 may be stopped.

The degree to which the reservoir is passively pressurized may be quantified by comparing the volume of the reservoir with the cap in the non-dispensing and dispensing positions. Such a comparison was performed on a fluid dispenser similar to that shown in FIGS. 1-4 by orienting the dispenser vertically, removing the tip 60, and completely filling the reservoir 18 and tip portion 16 with water while the cap was in the non-dispensing position. The weight of the water added to completely fill the reservoir 18 and tip portion 16 was then recorded. With the dispenser still in the vertical position, the cap was moved to the dispensing position, thereby compressing the reservoir and causing a portion of the water to be displaced. The weight of the water displaced from the reservoir was then recorded. Accordingly, a comparison of the weight of water displaced when the cap is placed in the dispensing position to the total weight of water in the reservoir and tip portion with the cap in the non-dispensing position may be expressed as a fluid displacement percentage. Furthermore, the recorded water weights are directly proportional to reservoir volume, and therefore provide a measure of the uncompressed reservoir volume when the cap is in the non-dispensing position and a compressed reservoir volume when the cap is in the dispensing position. Thus, the fluid displacement percentage quantifies the passive pressurization of the fluid reservoir.

The fluid displacement percentage described above should be sufficient to generate fluid flow but not too large that the fluid flow is excessive or uncontrollable. Accordingly, the fluid displacement percentage should be at least approximately 1% and no greater than approximately 25%. Preferably, the fluid displacement percentage falls within the range of 3-16%. As will be appreciated by those skilled in the art, the most desirable fluid displacement percentage will depend on the viscosity of the fluid and the resistance to flow caused by the particular tip used for the dispenser.

While certain preferred embodiments have been described, it will be appreciated that modifications may be made thereto without departing from the scope of the appended claims.

What is claimed is:

1. A fluid dispenser comprising:

a main dispenser body;

a fluid reservoir within the main dispenser body;

a substantially rigid tip portion provided on the main dispenser body and having a nib at a distal end thereof;

a cap selectively engageable with the substantially rigid tip portion;

the cap movable between a dispensing position and a non-dispensing position, said fluid reservoir being passively pressurized while the cap is in the dispensing position;

wherein the cap in the dispensing position facilitates application of a compressive force by a force member on the fluid reservoir, and wherein the cap in the non-dispensing position prevents the force member from applying said compressive force;

wherein the force member comprises a spring, and wherein disengagement of the cap from the substantially rigid tip portion facilitates the spring imparting the compressive force to the fluid reservoir.

2. The fluid dispenser of claim 1, wherein the main dispenser body comprises a compressible wall that defines the fluid reservoir, and wherein the compressive force imparted by the spring is applied to the compressible wall, thereby to pressurize the fluid.

3. The fluid dispenser of claim 1, wherein the spring is included as a portion of the cap.

4. The fluid dispenser of claim 1, wherein the spring is in selective engagement with the substantially rigid tip portion such that upon engagement therewith, the spring is prevented from imparting the compressive force to the fluid reservoir.

5. The fluid dispenser of claim 1, further comprising an interface associated with the fluid reservoir, said interface being engageable by an operator to actively increase flow of the fluid from the dispenser.

6. A fluid dispenser comprising:

a main dispenser body comprising a resilient material;

a cap in movable communication with the main dispenser body between a first dispensing position and a second non-dispensing position;

a fluid reservoir enclosed by the main dispenser body;

a substantially rigid tip portion provided at a distal end of the main dispenser body;

a nib provided in the tip portion and in communication with the fluid reservoir;

a spring disposed on the exterior of the main dispenser body, said spring being selectively engageable with the substantially rigid tip portion and, when disengaged from the substantially rigid tip portion, said spring imparting a compressive force to the main dispenser body, whereby the fluid reservoir enclosed therein is pressurized.

7. The fluid dispenser of claim 6, in which the fluid reservoir has an uncompressed volume when the cap is in the non-dispensing position and a compressed volume less than the uncompressed volume when the cap is in the dispensing position, wherein a difference between the uncompressed and compressed volumes defines a displacement volume.

8. The fluid dispenser of claim 7, in which the displacement volume is at least approximately 1% and no greater than approximately 25% of the uncompressed volume of the fluid reservoir.

9. The fluid dispenser of claim 7, in which the displacement volume is at least approximately 3% and no greater than approximately 16% of the uncompressed volume of the fluid reservoir.

10. The fluid dispenser of claim 6, further comprising a fluid flow control member disposed between the fluid reservoir and the nib.

11. The fluid dispenser of claim 10, in which the fluid flow control member comprises a valve.

12. A fluid dispenser comprising:

a main dispenser body made of a compressible material, and including a pair of opposing recesses in an outside thereof;

a fluid reservoir enclosed in the main dispenser body;

a substantially rigid tip provided on a distal end of the main dispenser body;

a generally U-shaped cap having first and second opposing legs, each of said legs having a ring projecting inwardly therefrom, said rings being rotatably received in the recesses;

a spring clip overlying the cap, said spring clip being generally U-shaped and having first and second legs biased toward one another;

said cap and overlying spring clip being rotatable relative to the main dispenser body between a closed position in which the first and second legs of the spring clip are forced apart from one another by the presence of said substantially rigid tip, thereby impeding the first and second legs of the spring from compressing the main dispenser body, and an open position, wherein the first and second legs of the spring cause the first and second legs of the cap to compress the main dispenser body, thereby pressurizing said fluid in said fluid reservoir.

13. The fluid dispenser of claim 12, in which the fluid reservoir has an uncompressed volume when the cap is in the non-dispensing position and a compressed volume less than the uncompressed volume when the cap is in the dispensing position, wherein a difference between the uncompressed and compressed volumes defines a displacement volume.

14. The fluid dispenser of claim 13, in which the displacement volume is at least approximately 1% and no greater than approximately 25% of the uncompressed volume of the fluid reservoir.

15. The fluid dispenser of claim 13, in which the displacement volume is at least approximately 3% and no greater than approximately 16% of the uncompressed volume of the fluid reservoir.

16. The fluid dispenser of claim 12, further comprising a fluid flow control member disposed between the fluid reservoir and the nib.

17. The fluid dispenser of claim 16, in which the fluid flow control member comprises a valve.

18. The fluid dispenser of claim 12, further comprising an interface on an exterior of the cap, said interface being operable to manually increase compression of the main dispenser body.

19. The fluid dispenser of claim 12, further comprising one or more locking tabs extending from each of the rings of the cap, and one or more complementary locking recesses extending from the opposing recesses in the main dispenser body, at least one of said one or more locking tabs and at least one of said one or more locking recesses arranged to selectively and releasably lock the cap in the closed position.

20. The fluid dispenser of claim 12, wherein another of said one or more locking tabs and another of said one or more locking recesses are further arranged to selectively and releasably lock the cap in the open position.

21. The fluid dispenser of claim 12, wherein the cap includes a recessed region on an outside surface thereof, and said spring clip being securely received within the recessed region.

* * * * *